United States Patent [19]

Wrubleski

[11] 3,954,578

[45] May 4, 1976

[54] METHOD FOR PRODUCING ALUMINUM

[76] Inventor: Paul S. Wrubleski, 2014 E. Hoffman Ave., Spokane, Wash. 99207

[22] Filed: Oct. 7, 1974

[21] Appl. No.: 512,918

[52] U.S. Cl. ..... 204/67
[51] Int. Cl.[2] ..... C25C 3/06
[58] Field of Search ..... 204/67

[56] References Cited

UNITED STATES PATENTS 3,616,315 10/1971 Childs ..... 204/67 X

*Primary Examiner*—Howard S. Williams
*Assistant Examiner*—Aaron Weisstuch
*Attorney, Agent, or Firm*—John R. Murtha

[57] ABSTRACT

In the electrolytic reduction of alumina an excess amount of cryolite bath is utilized to increase the amount of metal plated out. The carbon anodes are lowered into the excess bath to raise the liquid level of the bath above the normal operating level. Alumina is then added to saturate the upper portions of the excess bath and to form a thick crust over the pot. The carbon anodes are raised to their normal operating position and the bath periodically charged with alumina over the remainder of the run without breaking the crust. Molten aluminum leaches from the crust and augments the metal plated out and deposited at the bottom of the bath.

4 Claims, 2 Drawing Figures

METHOD FOR PRODUCING ALUMINUM

Figure 2:
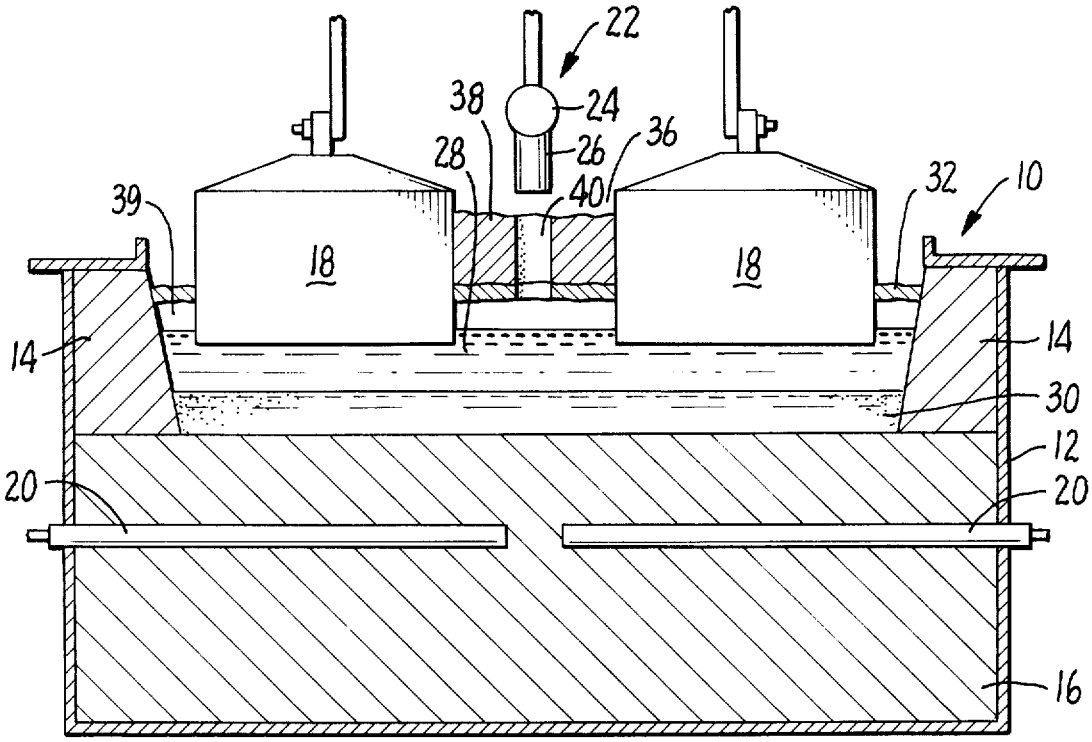

The invention relates to a method for producing aluminum, and more particularly to a method for increasing the aluminum yield from the electrolytic reduction of calcined alumina in a liquid cryolite bath.

Aluminum is produced in great quantities by the electrolytic reduction of alumina. In the reduction process, calcined alumina is periodically charged into a bath of liquid cryolite and molten aluminum is plated out and deposited at the bottom of the bath when a direct electrical current is passed therethrough. The electrolytic cells, or pots, as they are more commonly called, are made from heavy sheet steel. The pots are generally long and shallow and the sides and bottoms are lined with carbon. Carbon anodes are suspended in the liquid bath from overhead and are vertically adjustable with respect to the pots.

To start the process, cryolite in solid form is charged into the pot and melted down by lowering the carbon anodes to a point closely adjacent the bottom. When the melted cryolite fills the pot to the normal operating level, the carbon anodes are raised and calcined alumina is periodically charged into the molten bath over a period of time that may vary from 1 or 2 working shifts up to 2 or 3 days. During the period of the melt, or run, molten aluminum accumulates at the bottom of the pot. When a sufficient amount, or pad, of metal has collected at the bottom of the pot, the metal is tapped or siphoned into a crucible or pouring ladle. Molten aluminum metal is also collected from several other pots, skimmed and then poured from the crucible into molds.

The efficient operation of the foregoing process depends upon the careful regulation of a number of factors by the pot men — the workers who constantly tend the pots. Each pot man is responsible for several pots during his work shift. In addition to periodically charging the pots with alumina, the pot man must also properly position the carbon anodes in the pots during the run and maintain the proper amount of cryolite bath.

In the present invention, it has been found possible to dramatically increase the amount of aluminum plated out in the pots during a run or melt by making relatively minor alterations in the operation of the above described process. Moreover, the increase in aluminum yield is achieved without significantly increasing electrical consumption or cryolite requirements.

Briefly, and in general, the present invention concerns a novel method which apparently utilizes the reducing effect of the cryolite bath in a more efficient manner than previously known or used. In the prior art process described above, the experience of the art has been that only limited quantities of alumina can be reduced by the cryolite bath at any given time, hence, the practice of introducing the charges of alumina periodically over the course of each run or melt. Furthermore, the teaching in the art has been to run the pots with a predetermined amount of cryolite bath and to avoid any excess.

In applicant's invention, an excess amount of cryolite is utilized in a novel manner to increase the amount of aluminum deposited at the bottom of the pot. With an excess bath in the pot (either occurring naturally or produced deliberately), the carbon anodes are lowered so as to cause the liquid level of the bath to rise above the normal operating level. Alumina is quickly added to the cryolite in sufficient quantity to saturate the upper portions of it and the alumina-saturated cryolite is allowed to form a thick crust. The carbon anodes are then raised to their normal operating level with respect to the pot, thereby lowering the level of the bath back to normal. Raising of the anodes is done carefully to avoid breaking the crust formed by the saturated cryolite. The remaining portion of the run or melt is then carried out as previously described with periodic charges of additional alumina being introduced through the crust into the liquid cryolite bath in the customary manner. Observation of the thickened crust during the process indicates that molten drops of metal will form in situ and leach out as the crust gradually reduces in thickness. As a result of the indicated leaching effect, the thickness of the pad of molten aluminum at the bottom of the pot, and thus the amount of recoverable aluminum, is significantly increased. The increase in the thickness of the pad may have an adverse effect on the temperature of the metal and should be compensated for, otherwise, the lower portion of the metal may cool to a point where a complete tap or siphon cannot be obtained. Accordingly, the carbon anodes are adjusted prior to the tap so as to raise the voltage across the pot slightly. This voltage increase sufficiently raises the temperature of the bath to keep the thickened layer of aluminum completely molten and insures a tap of the metal that will include the increased yield.

Figure 1:
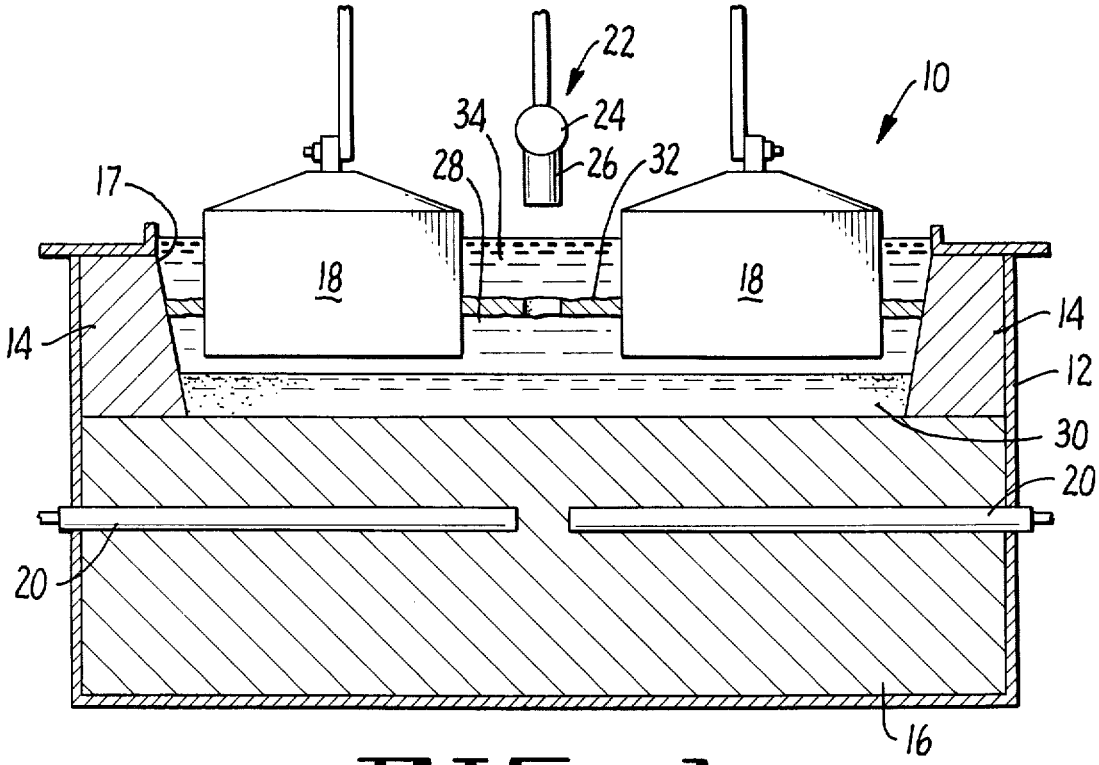

In the drawings:

FIG. 1 is a sectional view through one form of electrolytic cell showing the manner in which the level of the liquid bath is elevated above the normal operating level; and FIG. 2 is a similar sectional view showing the formation of a thickened crust over the liquid bath.

An illustrative electrolytic cell, or pot, used in the production of aluminum is shown in FIG. 1. The cell, or pot 10, is made up of an outer shell 12 of heavy sheet steel. The sides 14 and bottom 16 of the pot 10 are lined with carbon so formed as to define a long, narrow and shallow tank 17. The dimensions of the cell may vary substantially, but in the apparatus shown in the drawings, the tank is approximately 5 feet wide, 20 feet long, and from 14 to 24 inches deep.

Carbon anodes 18 are mounted over the tank 17 and, in accordance with accepted practice, are vertically adjustable with respect to the tank. As in the case of the cell itself, the configuration and dimensions of the carbon anodes may, and do, vary substantially. In the form of the apparatus shown in the drawings, each pot 10 is provided with two dozen anodes 18. As shown, each anode 18 is substantially square in configuraion and from 18 to 20 inches in dimension. The carbon anodes 18 are connected to a source of electrical energy (not shown), the voltage applied to the anodes being sufficient to pass a direct electric current through the cell or pot 10 (when filled with molten cryolite) to large collector bars 20 embedded in the carbon lining at the bottom of the pot. The cell or pot 10 shown in the drawings is but one of many and the collector bars 20 at the bottom of each pot are connected in series to the carbon anodes of the next adjacent pot so that all pots are connected in series.

A horizontal breaker arm 22 is also mounted above the pot 10 and extends longitudinally thereof. The breaker arm 22 consists of a horizontal member 24 that is secured to suitable apparatus (not shown) for moving the arm vertically with respect to the cell. The horizontal breaker arm is mounted beneath suitable storage hoppers (not shown) in which the alumina is stored and from which individual charges of alumina may be dumped into the pot as needed. Two vertically disposed ram-like projections 26 are disposed on the lower surface of the breaker arm 22 and serve as punches, or rams, to break openings in the crust which forms on the cell during the reduction of the alumina. By lowering the horizontal breaker arm 22 downwardly toward the cell 10, the projections 26 can be used to break holes in any crust which may form and allow the pot man to charge the cell with alumina.

In operation, each pot 10 is filled with cryolite, either the natural mineral or a synthetic. Initially, the cryolite 28 is introduced into the pot 10 as a solid. To melt it, the carbon anodes 18 are moved downwardly into the pot 10 to a point where they are almost touching the bottom. With the carbon anodes in this position, the passage of a direct current through the cell generates a high temperature which melts the cryolite to form a liquid bath. Once the cryolite has been melted to from a liquid bath 28, the anodes 18 are raised to their normal operating position. Calcined alumina is then periodically charged into the bath. Due to the passage of the electric current through the cell, the aluminum in the alumina is plated out in the form of a deposit of molten metal 30 at the bottom of the pot, while the oxygen in the alumina combines with the carbon in the anodes 18 to form both carbon dioxide and carbon monoxide. When the layer or pad 30 of molten aluminum has reached a sufficient thickness, it is tapped or siphoned from the cell 10 into a crucible. The crucible is filled from taps on other cells and the molten metal is skimmed and then poured into molds.

In the apparatus shown in the drawings for purposes of illustration, the pad of molten aluminum metal 30 at the bottom of the cell 10 will normally vary from about 3 inches in thickness to approximately 4 to 4 ½ inches in thickness. When the pad 30 is tapped or siphoned, it is customary to always leave between 3 and 4 inches of metal in the cell. Thus, each tap or siphoning of the cell removes from about ½ inch to 1 inch of metal from the pad.

As to the cryolite bath 28, normal operation in the apparatus shown in the drawings occurs with a depth of between 6 and 7 inches. By depth of bath is meant the distance from the top of the metal pad 30 at the bottom of the cell to the upper level of the liquid bath 28. For the apparatus shown, a depth of more than 7 inches of the liquid bath would be considered excess, that is, to be considered in excess of the amount required to reduce the alumina in the manner of the prior art. Inasmuch as the efficiency of the electrolytic process requires that a number of differing factors, including the depth of the cryolite bath, be carefully balanced, it has heretofore been a teaching of the art that an excess of cryolite bath is not desirable and should be avoided.

In the practice of the present invention, however, an excess amount of cryolite bath is utilized in a novel manner to increase the yield of the process. The amount of the cryolite bath 28 present in the cell is first determined by taking a measurement between the metal pad 30 and the upper level of the bath. In the apparatus shown in the drawings, a depth of 7 inches would be normal and any cryolite over this depth would be considered excess. Such an excess may occur either naturally or may be produced deliberately by the addition of more cryolite to the bath. It is also desirable that the thickness of the metal pad be at least 3 inches thick but less than 4 inches.

If the pot 10 has recently been tapped for metal, an air space 39 will normally exist between the crust and the upper level of the liquid bath 28. In the practice of the present invention, it is preferred to first break up and dissolve this crust. To do so, the carbon anodes 18 are raised so as to raise the voltage of the current passing through the bath. Care is taken, however, to avoid causing the so-called "anode effect." The pot man will then break down the crust either with the horizontal breaker arm 22 or with a hand poker. When the crust has been broken down into the bath 28, the carbon anodes 18 are lowered to their normal operating position and the voltage of the cell is cut back to a normal value. The top of the liquid bath is then covered with alumina and a thin, light crust 32 is allowed to form over the cell 10.

After a new crust 32 has been formed over the cell, the carbon anodes 18 are then lowered farther into the bath. The extent to which they are lowered depends on the amount of excess bath present. Lowering of the carbon anodes into the liquid bath 28 causes the liquid level of the bath 28 to rise above its normal operating level. There is a limit, however, to which the level of the bath can be raised. This limit is determined by the lowermost position of the breaker arm 22. The maximum bath level must be slightly below the position of the horizontal member 24 of the breaker arm 22 in its lowermost position so that operation of the breaker arm 22 will not breakdown any crust formed over the bath. Where possible, it is preferred to lower the anodes 18 in the apparatus shown in the drawings to a point where the voltage across the pot is reduced to approximately 4.25 volts. As the anodes 18 are lowered into the bath 28 the liquid cryolite passes upwardly through the ore feeding holes in the crust 32 and floods over the crust to a greater or lesser depth depending on the amount of excess bath in the pot. The excess cryolite bath 34 on top of the crust 32 is then saturated with alumina for the full length of the pot 10. In the form of the apparatus shown in the drawings, the saturation of the liquid bath 34 with alumina will occur at the center of the pot 10 in the space 36 between the two rows of carbon anodes 18. The saturation of the flooded cryolite with alumina is done as quickly as possible so as not to soften the crust 32 previously formed.

The carbon anodes 18 are then carefully raised to their normal operating position. Raising the carbon anodes 18 to their normal operating position will restore the voltage of the pot 10 back to its usual operating value. The raising of the carbon anodes will also cause the new thickened crust 38, as well as the original crust 32, to rise with the anodes (FIG. 2). Movement of the anodes to their normal operating position is done with the horizontal breaker arm 22 in its lowermost position so that openings 40 are formed in the thickened crust 38 for the subsequent charging of alumina into the liquid cryolite bath 28. A good cover of alumina is kept on the crust after the thickened crust 38 has "set up." The raising of the anodes to the normal operating position will again cause an air space 39 to exist between the crust 32 and the level of the cryolite bath 28. Subsequent charges of alumina are introduced into the cryolite bath in the customary way over the course of the run or melt to carry out the electrolytic reduction of the alumina in accordance with the known prior art method.

Observation during the remainder of the melt or run indicates that molten drops of aluminum form in the thickened crust 38. This aluminum will leach from the crust 38 and pass down through the bath 28 into the metal pad 30 at the bottom of the cell and augment the amount of metal deposited there. In this way, the thickness of the molten metal pad of aluminum formed at the bottom of the cell will be increased. As a result of the increased thickness of the metal pad at the bottom of the cell, the next subsequent tap or siphon will be significantly greater than it would otherwise have been had the excess amount of cryolite bath not been utilized in accordance with the present invention.

It has been found that with a hot bath caused by an "anode effect," the upper portions of the elevated cryolite bath can be saturated with alumina without first forming a crust over the bath. The "anode effect" is a sudden rise in the voltage across the pot. When the "anode effect" occurs the pot voltage may rise from about 10 or more volts to 30 or even 60 volts. Usually an incadescent light is connected across the terminals of the pot. Most of the time the light will glow dimly but when an "anode effect" occurs the light shines brightly and signals the pot man that corrective action is required. The usual corrective action is to quench the effect by lowering the anodes toward the bottom of the pot to reduce the voltage across the pot. The "anode effect" is accompanied by an increase in the temperature of the bath. If the "anode effect" is allowed to continue for even a relatively short time, the temperature of the bath can be significantly raised very quickly.

By quenching the "anode effect" slowly, the crust from the preceding run or melt can be quickly dissolved in the hot bath. When the crust has been broken down and dissolved into the bath, the carbon anodes are lowered toward the bottom of the cell without first forming another crust. As before, the lowering of the carbon anodes causes the level of the liquid bath to rise above the normal operating level. With the bath at this flooded level, the area between the carbon anodes and the center of the pot is again saturated with alumina in the manner previously described. The saturated alumina forms a thick crust between the carbon anodes. After the crust is formed, the carbon anodes are raised to their normal operating position. Raising of the anodes, and the crust in between them, is carried out with the horizontal breaker arm 22 in its lowermost position so that openings are formed in the crust for the subsequent charging of alumina into the liquid cryolite bath. Drops of molten aluminum will form in the crust. These drops of molten metal will gradually leach out of the crust and pass downwardly through the bath to the metal pad at the bottom of the pot.

The additional aluminum formed in the crust has been found to significantly increase the thickness of the pad of molten metal formed at the bottom of the pot. The increased thickness of the metal pad should be compensated for prior to the tap otherwise the full advantages of the invention will not be realized. The increased thickness of the metal pad tends to cool the lower portions of the pad to a point where a satisfactory tap may not be obtained at the normal temperature of the bath. It is believed that as the thickness of the pad increases the lower portions of the pad closest to the bottom of the pot tend to cool and solidify. To counteract this effect, the anodes are raised slightly so as to raise the voltage across the pot. Raising the voltage of the pot increases the temperature of the bath to a value which will maintain all portions of the metal pad in a molten condition. In the apparatus shown in the drawings, applicant has found that a voltage increase of 0.1 volt across the pot for a period of about 4 hours or more prior to tapping will be sufficient to counteract any cooling tendency in the metal pad.

I claim:

1. The method of producing aluminum by the electrolytic reduction of calcined alumina in a liquid cryolite bath containing vertically adjustable carbon anodes through which a direct electric current is passed, said method comprising the following steps:

a. providing an excess amount of liquid cryolite bath,
b. lowering the carbon anodes in the liquid cryolite bath to thereby raise the liquid level of the bath above the normal level of operation,
c. adding alumina ore to the elevated cryolite bath and forming a crust over the top of the bath,
d. raising the carbon anodes to lower the liquid level of the cryolite bath to the normal operating level, and
e. raising the voltage of the electrical current passing through said carbon anodes prior to tapping the molten aluminum.

2. The method of producing aluminum by the electrolytic reduction of calcined alumina in a liquid cryolite bath contained in a pot having vertically adjustable carbon anodes suspended in the bath and through which a direct electrical current is passed, said method comprising:

a. providing an amount of liquid cryolite bath in excess of the amount normally used in the pot,
b. breaking up and dissolving any crust over the bath that may have formed from prior operations,
c. covering the bath with alumina, allowing a crust to form, and then breaking holes in the crust,
d. lowering the carbon anodes in the bath to thereby raise the liquid level of the bath above the crust,
e. adding alumina to the cryolite bath on top of the crust until the upper portions of the elevated bath are saturated,
f. raising the carbon anodes to their normal operating position,
g. thereafter periodically charging the cryolite bath with alumina without breaking the crust of saturated cryolite over the bath, and
h. raising the voltage across the pot above normal value for at least four hours prior to the next tapping of the pot.

3. The method of producing aluminum by the electrolytic reduction of calcined alumina in a liquid cryolite bath contained in a pot having vertically adjustable carbon anodes suspended in the bath and through which a direct electrical current is passed, said method comprising:

a. providing an amount of liquid cryolite bath in excess of the amount normally used in the pot,
b. breaking up and dissolving any crust over the bath that may have formed from prior operations,
c. raising the temperature of the bath by producing an "anode effect" in the bath,
d. lowering the carbon anodes in the bath to end the "anode effect" and to thereby raise the liquid level of the bath above its normal level,
e. adding alumina to the raised bath to saturate the upper portions thereof.
f. allowing a crust to form over the bath, g. raising the carbon anodes to their normal operating position, h. thereafter periodically charging the cryolite bath with alumina without breaking the crust of saturated cryolite, and i. raising the voltage across the pot above normal value for at least four hours prior to the next tapping of the pot.

4. The method of claim 3 wherein said voltage is raised 0.1 volt.

* * * * *